US007694737B2

(12) United States Patent
Sun et al.

(10) Patent No.: US 7,694,737 B2
(45) Date of Patent: Apr. 13, 2010

(54) METHOD OF BLOCKING WATER-OUT ZONE IN A GAS WELL BY DUMPING CEMENT AND INJECTING PRESSURIZING GAS

(75) Inventors: Chi-San Sun, Miaoli (TW); Chien-I Wu, Miaoli (TW); Chia-Shui Wu, Miaoli (TW); Lai-Fuh Fan, Miaoli (TW); Te-Kun Huang, Miaoli (TW); Chen-Hui Fan, Miaoli (TW)

(73) Assignee: CPC Corporation, Taiwan, Taipei (TW)

( * ) Notice: Subject to any disclaimer, the term of this patent is extended or adjusted under 35 U.S.C. 154(b) by 155 days.

(21) Appl. No.: 11/939,952

(22) Filed: Nov. 14, 2007

(65) Prior Publication Data

US 2009/0120643 A1 May 14, 2009

(51) Int. Cl.
*E21B 33/138* (2006.01)

(52) U.S. Cl. ..... 166/286; 166/295

(58) Field of Classification Search ..... None
See application file for complete search history.

(56) References Cited

U.S. PATENT DOCUMENTS 2,956,624 A * 10/1960 Toelke ..... 166/63
3,616,856 A * 11/1971 Knight et al. ..... 166/288

* cited by examiner

*Primary Examiner*—Zakiya W. Bates
(74) *Attorney, Agent, or Firm*—Rabin & Berdo, PC

(57) ABSTRACT

In a method of blocking a water-out zone in a gas well by dumping cement and injecting pressurizing gas, a gas is injected into a target well to push and press accumulated water in the well back into the formation surrounding the well, so that the well is water-free; meanwhile, a dump bailer is lowered to the water-out zone in the well using a wire line. When the dump bailer has reached the water-out zone, it is controlled to open a bottom opening thereof to release cement milk loaded therein. The released cement milk accumulates in the water-out zone and then slowly flows into a gravel layer between a screen pipe and a wall of the well. The gas injection continues until the cement milk is cured and hardened to achieve the object of blocking the water-out zone.

9 Claims, 14 Drawing Sheets

| | Particle size (microns) | Necessary pore size (microns) | Equivalent permeability (Darcy) | Grain max size (microns) | Mesh number |
|---|---|---|---|---|---|
| Class G | 100 | 500 | 234 | 2000 | 10 |
| Microcement | 42 | 210 | 41 | 840 | 20 |
| | 30 | 147 | 20 | 590 | 30 |
| | 13 | 62 | 4 | 250 | 60 |
| SqueezeCRETE | 7 | 37 | 0 | 149 | 100 |
| Solid free treatment* | 6 | 31 | 1 | 125 | 120 |
| | 5 | 23 | 0.5 | 90 | 170 |

*FIG. 9*

| Run No. | Pwh (psig) | Slurry Volume (L) | Bottom Nose Position | Cement Head (m) | △h (m) | Note |
|---|---|---|---|---|---|---|
| 1 | 2150 | 20.3 | *8 | 2815.9 | 0.10 | (1) Inject gas for 5 hours. Then, pause the gas injection for 15 minutes to carry out cement dumping. During this period, the wellhead pressure is slowly cement dumping. During this period, the wellhead pressure is slowly. (2) When the cement dumping is completed, resume the gas injection. Total gas injection time before and after the cement dumping is about 30 hours. |
| 2 | 2140 | 20.3 | *8 | 2815.0 | 0.90 | (1) Inject gas for 4 hours. Then, pause the gas injection for 10 minutes to carry out cement dumping. During this period, the wellhead pressure is slowly (2) When the cement dumping is completed, resume the gas injection. The wellhead pressure is maintained at 2140 psi, and the gas injection continues for about 27 hours. Total gas injection time before and after the cement dumping is about 31 hours. |
| 3 | 2480 | 20.3 | *8 | 2814.9 | 0.10 | (1) Inject gas for 3 hours (with a wellhead gas injection pressure of 2480 psi). When the dump bailer is lowered to well bottom, the gas injection is paused, and the wellheadpressure is dropped to 1960 psi. The cement milk is dumped. The gas injection is paused for about 15 minutes. After the cement dumping, the gas injection is resumed, and the wellhead pressure is dropped from the highest level of 2560 psi to 2480 psi(the same as the initial gas injection pressure). The gas injection continues for another 24 hours. |

*FIG. 10*

METHOD OF BLOCKING WATER-OUT ZONE IN A GAS WELL BY DUMPING CEMENT AND INJECTING PRESSURIZING GAS

FIELD OF THE INVENTION

The present invention relates to a method of blocking a water-out zone in a gas well by dumping a cement and injecting a pressurizing gas, and more particularly to a method of handling a water coning condition in a gravel packed gas well by injecting the pressurizing gas into the well to push accumulated water back into the formation, and dumping and pressing a cement milk into gaps between the gravels and the wall of the well, so that the cement milk is cured to block the water-out zone in the well.

BACKGROUND OF THE INVENTION

Natural gas and water coexist in the stratum at where a gas production well is drilled. Since the specific gravities of a natural gas is lower than that of water, the natural gas is stored over the water. During the process of the natural gas production, the pressure within the system would gradually drop, and formation of water would gradually rise to approach the production well being drawn and tend to enter the production well to adversely affect the gas production.

Generally, entering of water into a production well might be caused by different reasons, such as a high permeability sub-formation at the production zone that results in an earlier edge encroachment on the well; vertical cracks or faults within the production zone in resulting the water that is formed in the bottom flowing into the upper production zone; fissures on a casing or a plug set in the well; and poor cement bond at the casing of the well. A rising water gas contact (WGC) might even induce water coning to result in an increased water flowing rate and a shutoff of the well. Under these conditions, the water must be completely shut off lest it should rise and invade the well to adversely affect the gas production at other zones.

In the case of a gravel packed production well subjected to water invasion, since the gravels between a screen pipe and a wall of the well is highly permeable and there is not a casing provided at the production zone, both of the mechanical type bridge plug and the thermal expansion type patch flex are not applicable to block the perforated zone under the WGC for the purpose of continuing the gas production of the well.

The conventional bridge plug can only be mounted in the screen pipe, and does not provide the function of blocking tiny meshes on the screen pipe and the gravels outside the screen pipe. That is, the conventional bridge plug does not function to seize information water from flowing into the well. Similarly, the thermal expansion type patch flex must also be provided in the screen pipe. As to the conventional way of pumping gel into the gravel packed production well using coiled tubing, since the tiny meshes on the screen pipe and the gravels outside the screen pipe are highly permeable, the pumped gel would inevitably flow through the gravels and fail to completely enter a water-out zone in the production well.

Regarding the way of placing traditional G-grade or H-grade cement milk at the bottom of the well to block the water-out zone, it is also not applicable because the cement has large particle size and cannot pass through the screen pipe into the gravels easily. Therefore, once the bottom of the gravel packed production well is subjected to invasion by water, there is no way to save the well but leaving it to the rising water until the well is no longer economical for use and shut off, or until the invaded water accumulates in the oil pipe and the well no longer produces any oil or gas.

For gravel packed production wells, a most common way of stopping water invasion is to use thermosetting resin or fine-grained cement milk to block the water-out zone in the production well. In most cases, the resin used for this purpose is phenolic resin; however, in the case of stopping water invasion with the thermosetting resin, the formation water would still break through a joint of the gravels and the well wall to largely reduce the water blocking effect, provided the differential pressure at the well bottom exceeds 50 pounds when the well resumes production. There is also a limitation to the cement used to block water. Only the ultra-fine-grained cement can flow into the gravels to completely fill up the pore space thereof, and thus blocks the water-out zone after the cement is cured.

In performing water blocking for the gravel packed production well, a dump bailer is used to carry the cement milk, resin, or other types of treating fluids. The dump bailer is a cylindrical container being lowered to the bottom of the well or a desired depth in the well using a wire line. A signal is transmitted from the ground to open the dump bailer and release the treating fluid (i.e., resin or cement milk) loaded therein. Due to a difference in specific gravity between the treating fluid and the formation water, the treating fluid is able to flow into the gravels between the screen pipe and the well wall. When the treating fluid is cured, the water-out zone is blocked.

The conventional water blocking method as described above has several disadvantages:

(1) The cement milk or resin mixed with the formation water is diluted to adversely affect the subsequent curing of the cement milk or resin.

(2) The gravel layer must not be overly contaminated to result in uneven permeability thereof. The gravel layer is used to retard sand. When the well has produced gas for a period of time, the gravel layer thereof would inevitably be contaminated by dust and sand from the producing formation. Under this condition, the cement milk or resin that flowed into the gravel layer are simply due to the gravity force not being able to fully fill all the pores in the gravel layer and completely block the water coning at the bottom of the well.

(3) When a production well is subjected to water invasion, a water column is accumulated at the bottom of the well. When the cement milk or the resin is dumped into the bottom of the well, the formation water would form a thin membrane on the well wall. When the cement milk or the resin is cured and the well is reopened for production, a large pressure difference as high as several tens to several hundreds of pounds between the bottom of the well and the formation will exist. This pressure difference would cause the bottom water to flow into the well bore via the tiny clearance between the cement milk and the well wall; furthermore, the water-out zone could not be blocked at all. As mentioned above, in the case of stopping water invasion with the thermosetting resin, the formation water would still break through the joint of the gravels and the well wall, provided the differential pressure at the well bottom exceeds 50 pounds.

SUMMARY OF THE INVENTION

A primary object of the present invention is to provide a method to block water-out zone in a gas well by dumping cement and injecting pressurizing gas, and result in a blocking of the water-out zone in the well with a higher probability of success. Furthermore, the well subjected to water coning could resume gas production to save the cost of drilling a new well and provide good economic effect.

Another object of the present invention is to provide a method of blocking the water-out zone in a gas well by dumping cement and injecting pressurizing gas. By doing so, the water accumulated in the well can be pushed and pressed back into the formation to successfully flow into the gravel layer surrounding the well and become cured at the joint of the gravel layer as well as the well wall to block off any passage via which the formation water invades the well.

To achieve the above and other objects, the water blocking method of the present invention includes the following steps:

(a) A continuous injection of gas into a target well for a predetermined period of time so the water that accumulated in the well is pushed and pressed back into the formation and surround the well to keep the well in a water-free state;

(b) to load a type of pre-prepared blocking fluid or treating fluid in a dump bailer, and lower the loaded dump bailer to a water-out zone to blocked in the target well;

(c) to pause the gas injection or to decrease the pressure of the injected gas for a predetermined time period when the dump bailer has reached at the water-out zone, and keeping the wellhead shut-in pressure higher than a wellhead pressure before the gas injection;

(d) to control the dump bailer to open a bottom opening thereof to release the loaded blocking fluid, so that the blocking fluid is accumulated in the water-out zone; and (e) to resume the gas injection and continuously increase the gas pressure until the blocking fluid is cured and hardened to form a reliable water blocked zone.

The blocking fluid is cement milk or liquid resin.

In a preferred embodiment, the injected pressurizing gas is a natural gas.

In a preferred embodiment, the dump bailer has a throttle unit mounted to a bottom end thereof for controlling the loaded blocking fluid to release at a predetermined flow speed.

In an operable embodiment, the predetermined period of time for pausing the gas injection is from 10 to 30 minutes. When the blocking fluid has completely released from the dump bailer, the gas injection resumes and continues until the blocking fluid is fully cured and hardened; moreover, the cement milk is so prepared that it has a plastic viscosity less than 22 cp.

In an ideal embodiment, the dump bailer lowered from the wellhead must reach at the water-out zone within 60 minutes; and the dump bailer is slowly lifted by a predetermined distance while the blocking fluid is slowly released from the dump bailer at a predetermined flow speed.

BRIEF DESCRIPTION OF THE DRAWINGS

The structure and the technical means adopted by the present invention in achieving the above and other objects can be best understood by referring to the following detailed description of the preferred embodiments and the accompanied drawings, wherein FIG. 1 schematically shows a gravel packed production well having formation water flowed thereinto;

FIG. 9 lists the pore throat sizes required by different types of cement milk to permeate into the gravels, and the permeability of each of these different types of cement milk;

FIG. 10 shows data about the water blocking operations performed using the method according to a preferred embodiment of the present invention;

DETAILED DESCRIPTION OF THE PREFERRED EMBODIMENTS

Figure 1:
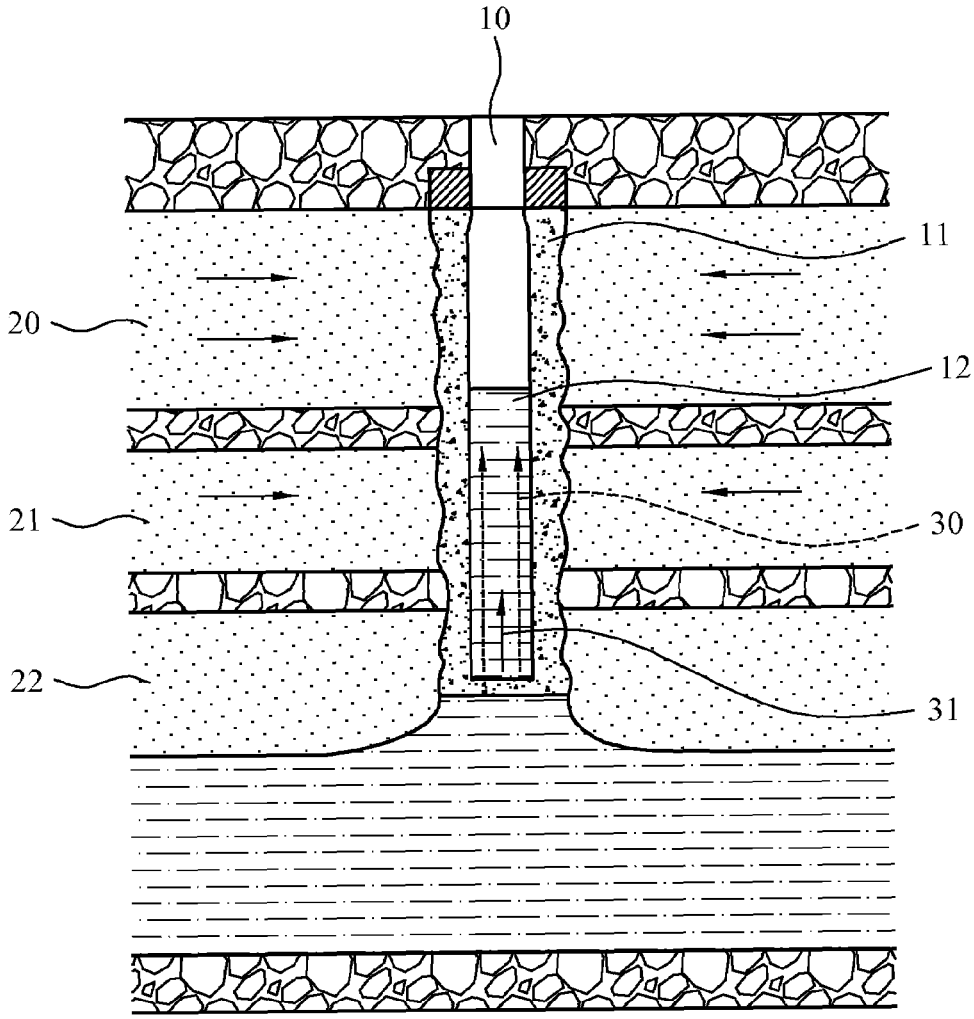
Figure 2:
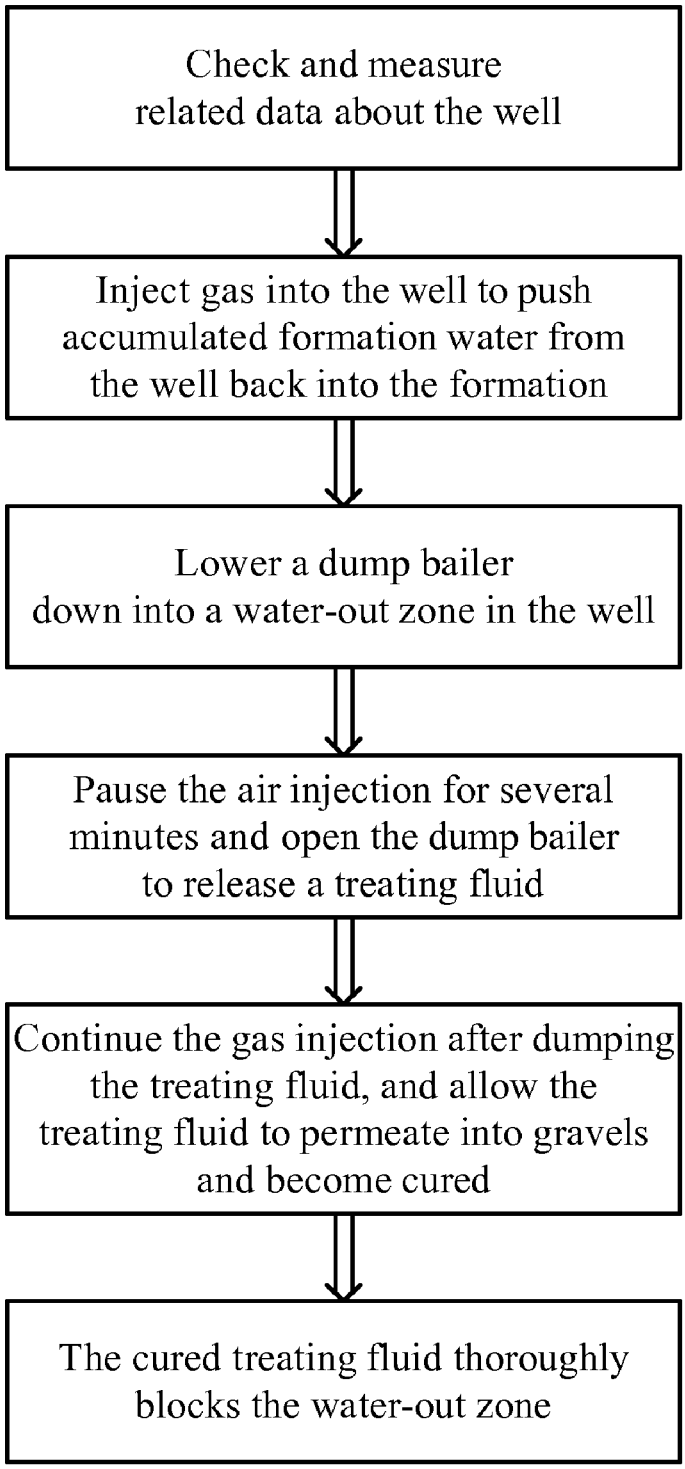
FIG. 2 shows the steps included in the method of the present invention for blocking water-out zone in a gas production well.
Figure 3:
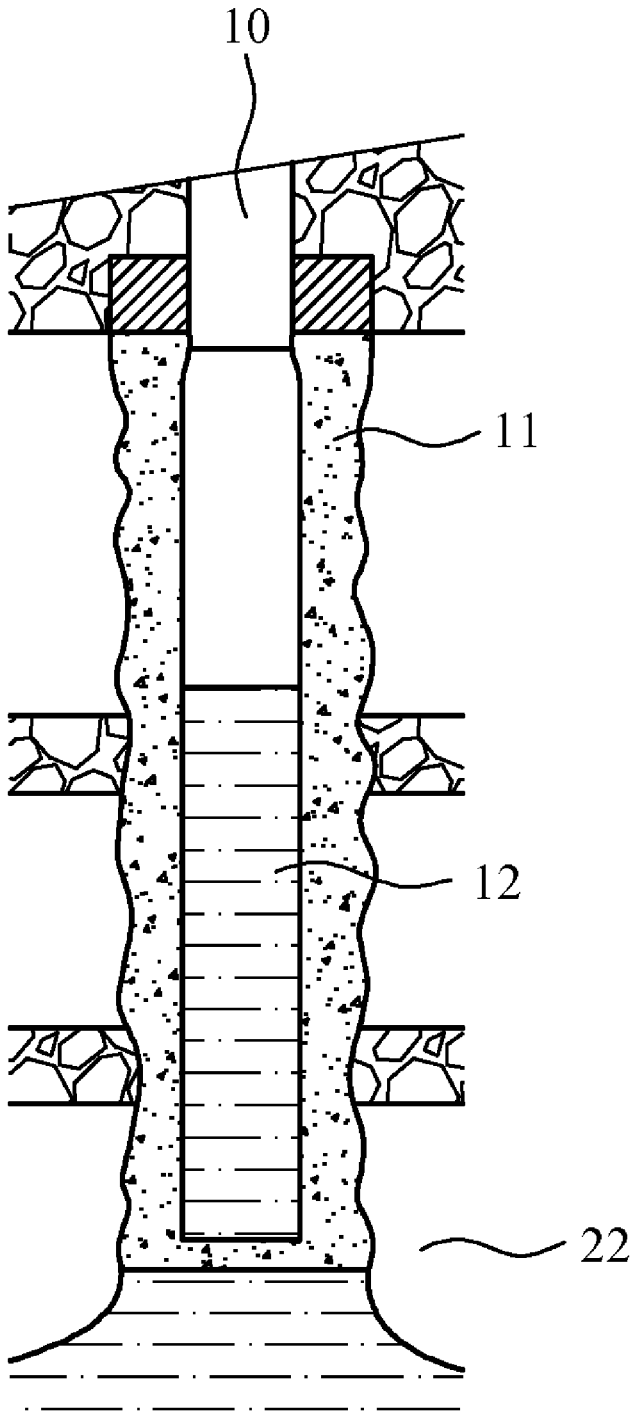
FIG. 3 schematically shows a gravel packed production well having water accumulated in the tubing thereof.

Please refer to FIG. 1. Following the gas production in a gravel packed production well 10, the water gas contact (WGC) in the well gradually rises. As a result, the water is produced along with the gas. In the illustrated embodiment in FIG. 1, the gravel packed production well 10 downward penetrates through three vertically distributed oil/gas reservoirs, which are, from top to bottom, first oil/gas producing formation 20, second oil/gas producing formation 21, and third oil/gas producing formation 22, and are separated from one another by water-impermeable shale. As can be clearly seen from FIG. 1, a water coning occurs at the third oil/gas producing formation 22 and rises into the gravel packed production well 10. As a result, the produced water 30 constantly increases in volume while the volume of produced gas 31 continuously decreases, as indicated by the vertical arrows in FIG. 1. In the event the third oil/gas producing formation 22 is not blocked, the produced water 30 would continuously permeate into and accumulate in the gravel packed production well 10 until the well is naturally depleted and no longer produces gas.

Figure 4:
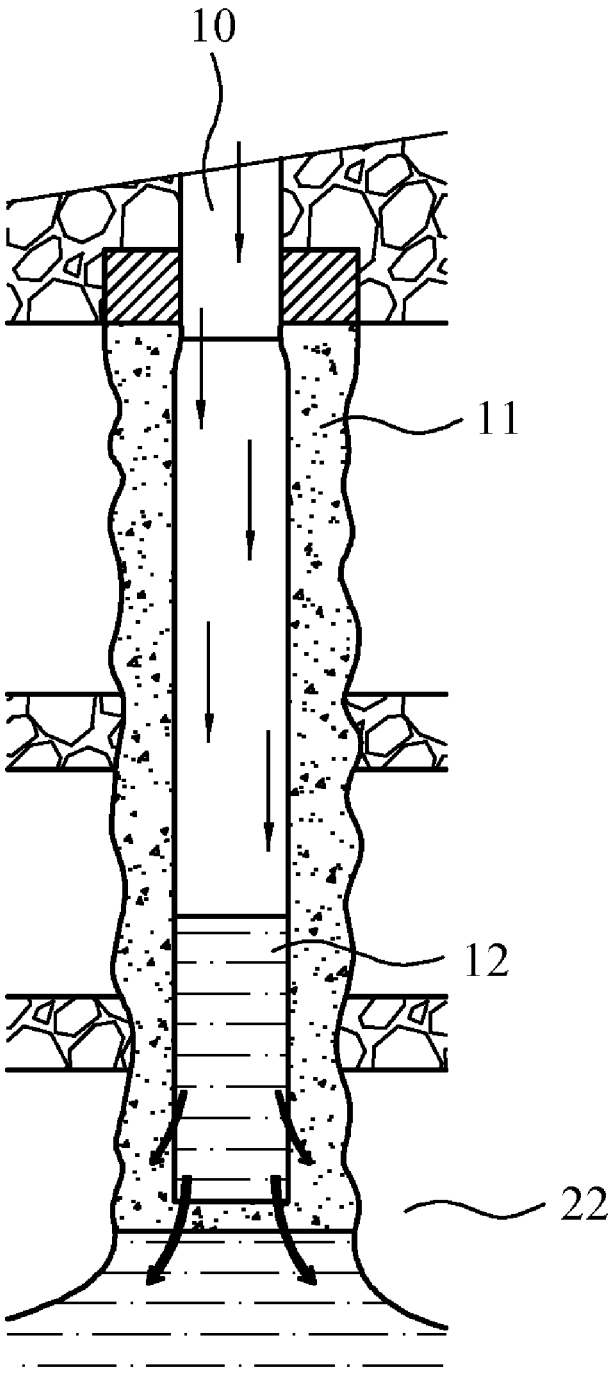
FIG. 4 shows the injection of pressuring gas into the gas production well to push and press the accumulated water therein.
Figure 5:
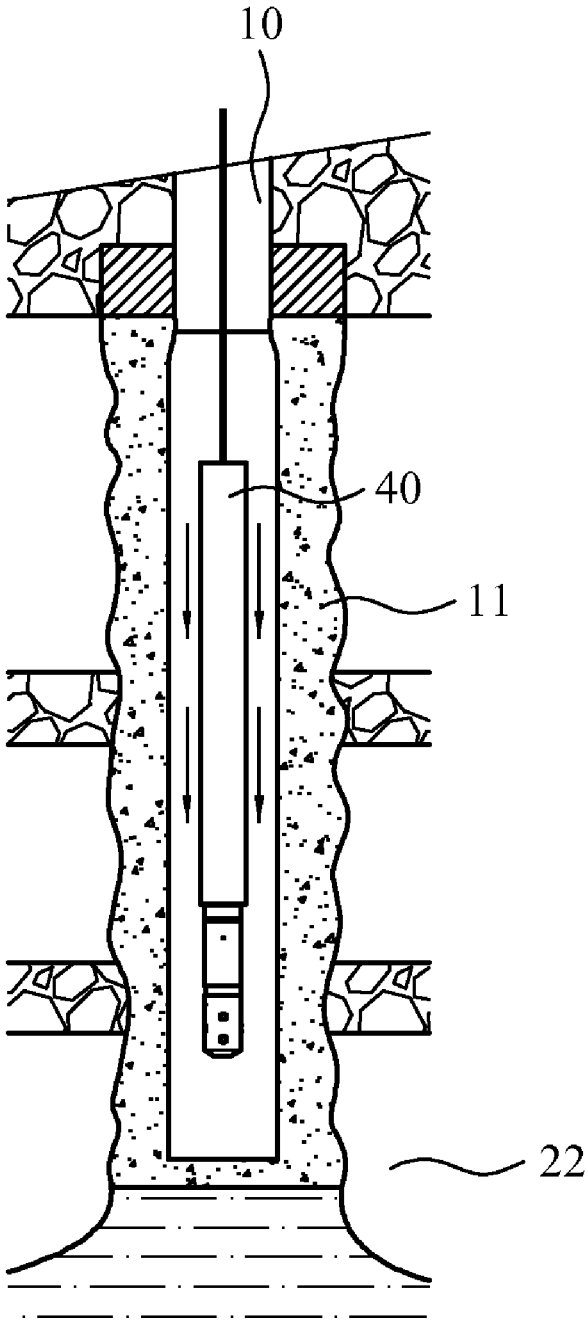
FIG. 5 shows the lowering of a dump bailer in the gas production well to block a water-out zone.
Figure 6:
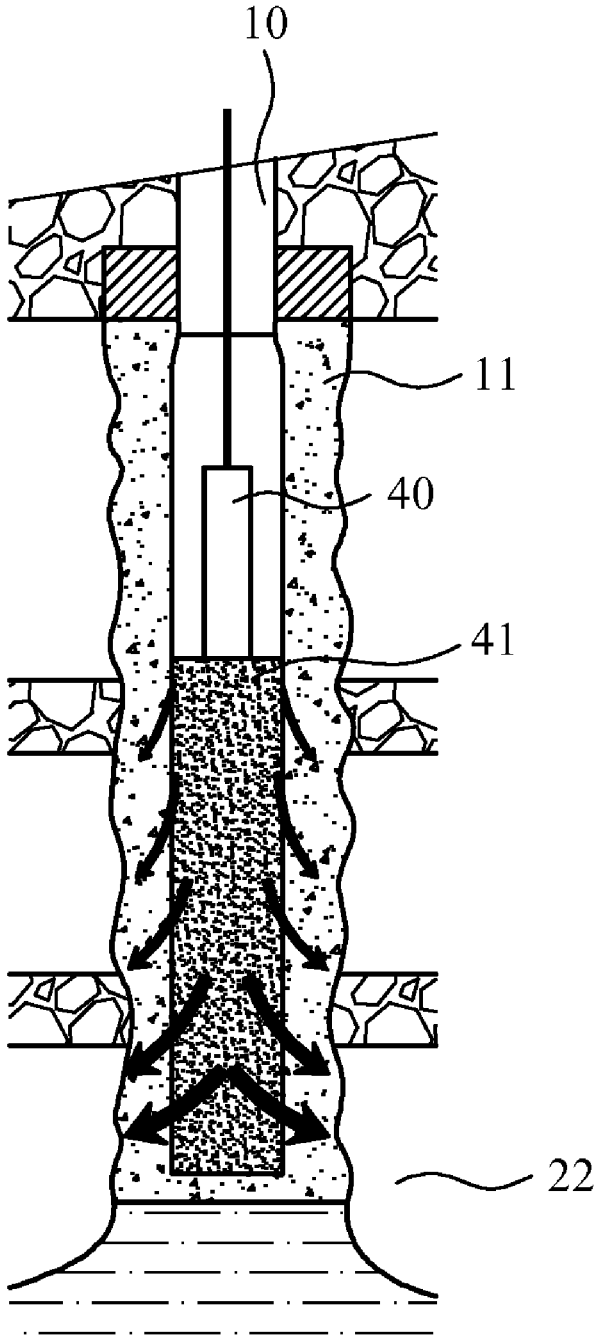
FIG. 6 shows treating fluid released from the dump bailer shown in FIG. 5.
Figure 7:
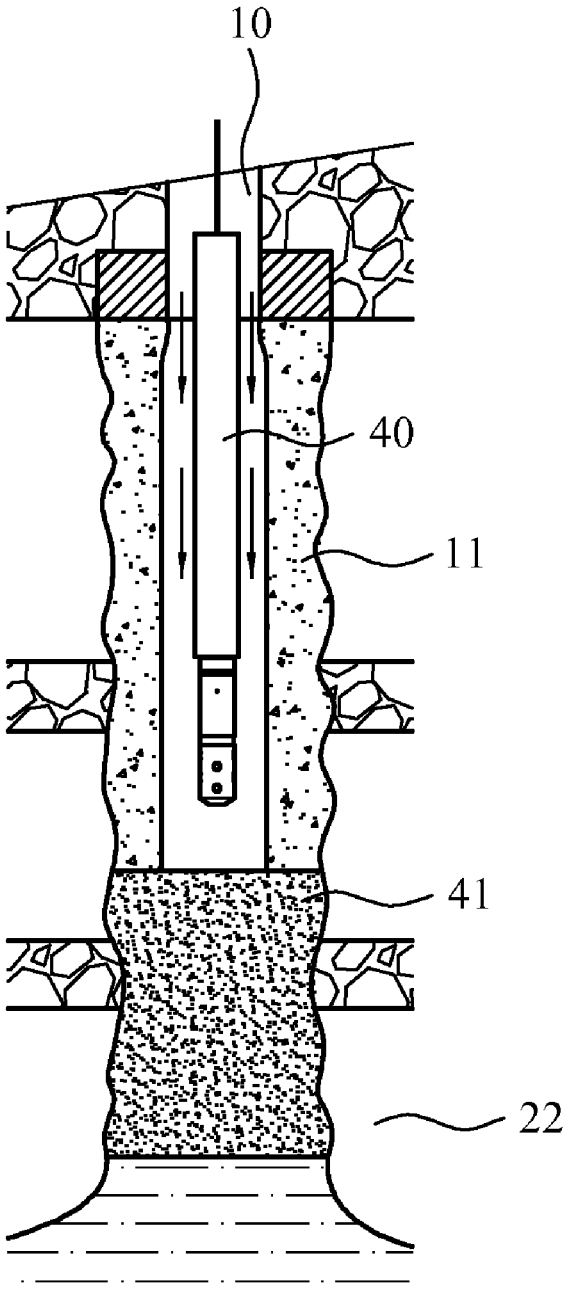
FIG. 7 shows the completion of releasing the treating fluid from the dump bailer and follow by a resume of pressurizing gas injection.

Please refer to FIGS. 1 to 8 at the same time. The present invention provides a method of blocking water-out zone in a gas well by dumping cement and injecting pressurizing gas thereinto. To perform water block operation in the gravel packed production well 10, first cut off the communication between the screen pipe and the third oil/gas producing formation 22, so that the water-out zone along with the shale thereabove are simultaneously blocked. The water blocking method of the present invention includes the following steps:

(1) To check and measure related information and data about the production well 10, including, for example, facility arrangements, temperature, pressure, and etc. in the production well 10; (2) To inject pressurizing gas into the gravel packed production well 10 to push accumulated water 12 from the well 10 back into the formation, as shown in FIG. 4, so that the well 10 is maintained in a water-free state; (3) meanwhile, use a wire line to lower a dump bailer 40 down into the production well 10 to block a water-out zone, as shown in FIG. 5; (4) when the dump bailer 40 has reached at the water-out zone, a bottom opening of the dump bailer 40 is opened to release a treating fluid 41 loaded therein; (5) To allow the released treating fluid 41 to accumulate in the water-out zone and then slowly flow into a gravel layer 11 surrounding the well 10 and finally reach at an inner edge of the gravel layer 11, as shown in FIG. 6. Meanwhile, resume the injection of the pressurizing gas to push and press the treating fluid 41 into pores in the gravel layer 11 as well as the gaps between the gravel layer 11 and the well wall; and (6) To continuously inject the pressurizing gas into the production well 10 until the treating fluid 41 is cured to reliably block the water-out zone and thereby thoroughly shut off the third oil/gas producing formation 22, as shown in FIG. 7.

Wherein, the treating fluid 41 may be cement milk or liquid resin.

In a preferred embodiment of the present invention, the dump bailer 40 includes a throttle unit mounted to a bottom thereof for controlling a flow rate of the treating fluid 41 released from the dump bailer 40. By setting a suitable flow rate for the treating fluid 41 via the throttle unit of the dump bailer 40, the released treating fluid 41 may timely become cured to completely stop water at the water-out zone.

In an operable embodiment of the present invention, natural gas is continuously injected into the target well for several hours to push the accumulated water 12 in the well 10 back into the formation. Meanwhile, the dump bailer 40 with particularly prepared cement milk loaded therein is lowered down to the water-out zone. Before the bottom opening of the dump bailer 40 is opened to release the treating fluid 41, either the injection of pressurizing gas is paused nor the pressure of the injected gas is reduced for several minutes. However, care must be taken to ensure that a wellhead shut-in pressure at this point is still larger than the pressure before the gas injection. When the cement milk has been completely dumped into the well, the injected pressurizing gas is resumed to an initial pressure thereof and the injection continues for more than 24 hours, so that the cement milk is continuously pressed to allow an easier flow into the gravel layer 11. When the cement milk is fully cured, it is able to completely block the water-out zone.

In an operable embodiment, the duration for pausing the injection of pressurizing gas is from 10 to 30 minutes.

Figure 8:
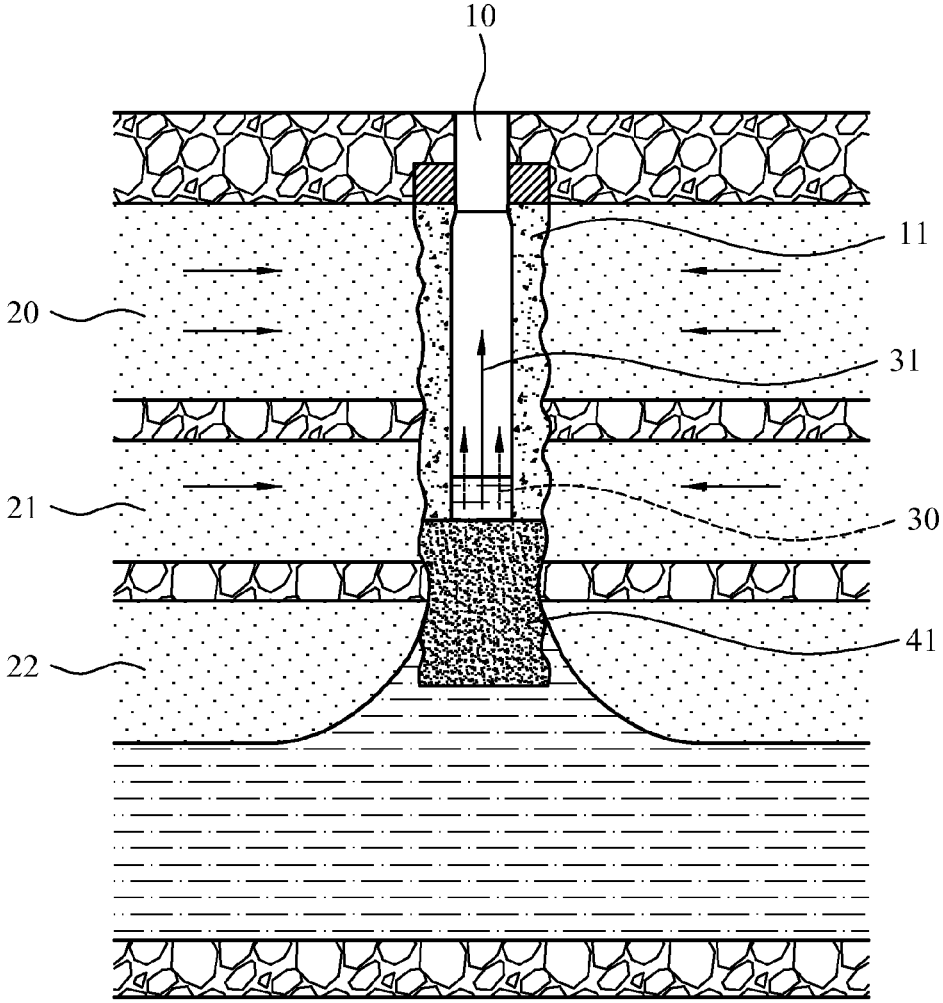
FIG. 8 shows the water-out zone in the gravel packed production well has been blocked and gas is produced when the production well is reopened.

Please refer to FIG. 8. When the cement milk is cured, the third oil/gas producing formation 22 is effectively blocked, the produced water volume 30 in the well 10 is reduced, and the gas production volume 31 gradually recovers, as indicated by the vertical arrows in FIG. 8. With the fully cured cement milk, a reliable blocked zone is formed at the third oil/gas producing formation 22 and the shale thereabove. The formation water in the third oil/gas producing formation 22 is stopped from entering the gravel packed production well 10.

In a preferred embodiment of the present invention, it is ensured the prepared cement milk has a plastic viscosity less than 22 cp; the dump bailer 40 lowered from the well head must reach at the water-out zone within 60 minutes; when the dump bailer 40 has reached at the water-out zone, the cement milk is released from the dump bailer 40 at a slow flow rate; and the dump bailer 40 is slowly lifted by 80 cm to 100 cm during the release of the cement milk, lest the level of the cement milk in the screen pipe should instantaneously rise by a large distance to contaminate an upper part of the gravel layer 11 and adversely affect the subsequent cement dumping operation.

In another preferred embodiment, the loading of the cement milk into the dump bailer 40 is done in an environment that is not directly exposed to sunlight and has an ambient working temperature kept at as low as possible to avoid the cement milk from curing too early.

Please refer to FIG. 9. Most general types of cement milk have a large particle size and therefore could not pass through the screen pipe into the gravel. In the present invention, the adopted cement milk is preferably SqueezeCRETE, which has ultra-fine particle size and is therefore quite different from the G-grade cement normally used in oil/gas well. An averaged maximum particle size distribution of the SqueezeCRETE is 5~7 μm. Generally speaking, for a liquid mixture containing solid particles to pass through a porous medium, the porous medium must have a pore throat size at least 5~10 times larger than the diameter of the largest solid particles in the liquid mixture to avoid the solid particles from being stuck to and accumulated at the pore throat of the porous medium to interrupt the flowing of subsequent particles through the medium. As can be clearly seen from FIG. 9, the general G-grade cement is not able to flow into the gravel. As to the Micro-cement, it has a particle size about 30 μm and should be able to flow into the gravels; however, in a water-invaded gas well, it is very possible that the gravel layer 11 have already been filled with fine particles from the production zone, and part of the pore space in the gravel is clogged to reduce the permeability of the gravel layer 11, preventing the cement milk from flowing into the gravel layer 11 easily. These conditions tend to cause incomplete blocking and accordingly poor water blocking effect. In the present invention, the injection of pressurizing gas into the water-out zone is helpful in forcing the fine particles in the pores of the gravel layer 11 back into the producing formations, so that the cement milk could more easily permeates into the gravels.

Please refer to FIG. 10 that shows some data about the water blocking operations performed in a gas well using the method according to a preferred embodiment of the present invention. Before the water blocking operations, the produced water from the target well is as high as 122 KL/day, the bottom-hole radial pressure is 2387 psia, and the well depth is 2816.0 meters.

The following is a description of the actual operations carried out in an experimental process based on the method of the present invention. In the first time water blocking operation, natural gas is injected into the target well for 5 hours. The gas injection is then paused for 15 minutes to carry out the cement dumping. During this period, the wellhead pressure is slowly dropped from 2150 psig to 1920 psig, and in total of 20.3 liters of cement milk has been dumped. After the cement dumping, the gas injection is resumed and continues for another 24 hours. The cement head rises by 0.1 meter and the well depth changes from 2816.0 meters to 2815.9 meters.

In the second time water blocking operation, the gas injection continues for 4 hours and is then paused for 10 minutes to carry out the cement dumping. During this period, the wellhead pressure is slowly dropped from 2140 psig to 1900 psig, and total 20.3 liters of cement milk has been dumped. After the cement dumping, the gas injection is resumed, the wellhead pressure is maintained at 2140 psig, and the gas injection continues for another 27 hours. The cement head rises by 0.9 meter and the well depth changes from 2815.9 meters to 2815.0 meters. Thereafter, the well is opened to allow the gas flow for 10 days. During this period, the wells is closed for 1 day, and in total of 560 cubic meters of water are expelled, and the final produced water is reduced to 47 KL/day. The target well is now a flowing well to produce gas.

To reinforce the water blocking effect, the third time water blocking operation is carried out. In this operation, the wellhead gas injection pressure is raised to be 2480 psig and the gas injection continues for 3 hours. When the dump bailer is lowered to the well bottom, the gas injection is paused, and the wellhead pressure is dropped to 1960 psig. The cement milk is dumped. The gas injection is resumed after having been paused for about 15 minutes, and the wellhead pressure is dropped from the highest level of 2560 psig to 2480 psig. The gas injection continues for another 24 hours, the cement head rises by 0.1 meter, and the well depth is changed from 2815.0 meters to 2814.9 meters.

When the cement dumping operation has been completed under the third time gas injection and pressurization, the well is opened to allow gas flow. The water blocking effect of the present invention is tested in three stages:

In the first stage, a 32/64" choke is used to open the well for production, and the gas flows to the wellhead automatically. In the initial stage, the wellhead flow pressure is 1660 psi, and the produced gas volume is about 370,000 cubic meters per day. After 20 hours, the produced water appears, and the wellhead flow pressure gradually drops to 1560 psi. The well is opened for production for 4 days.

Figure 11:
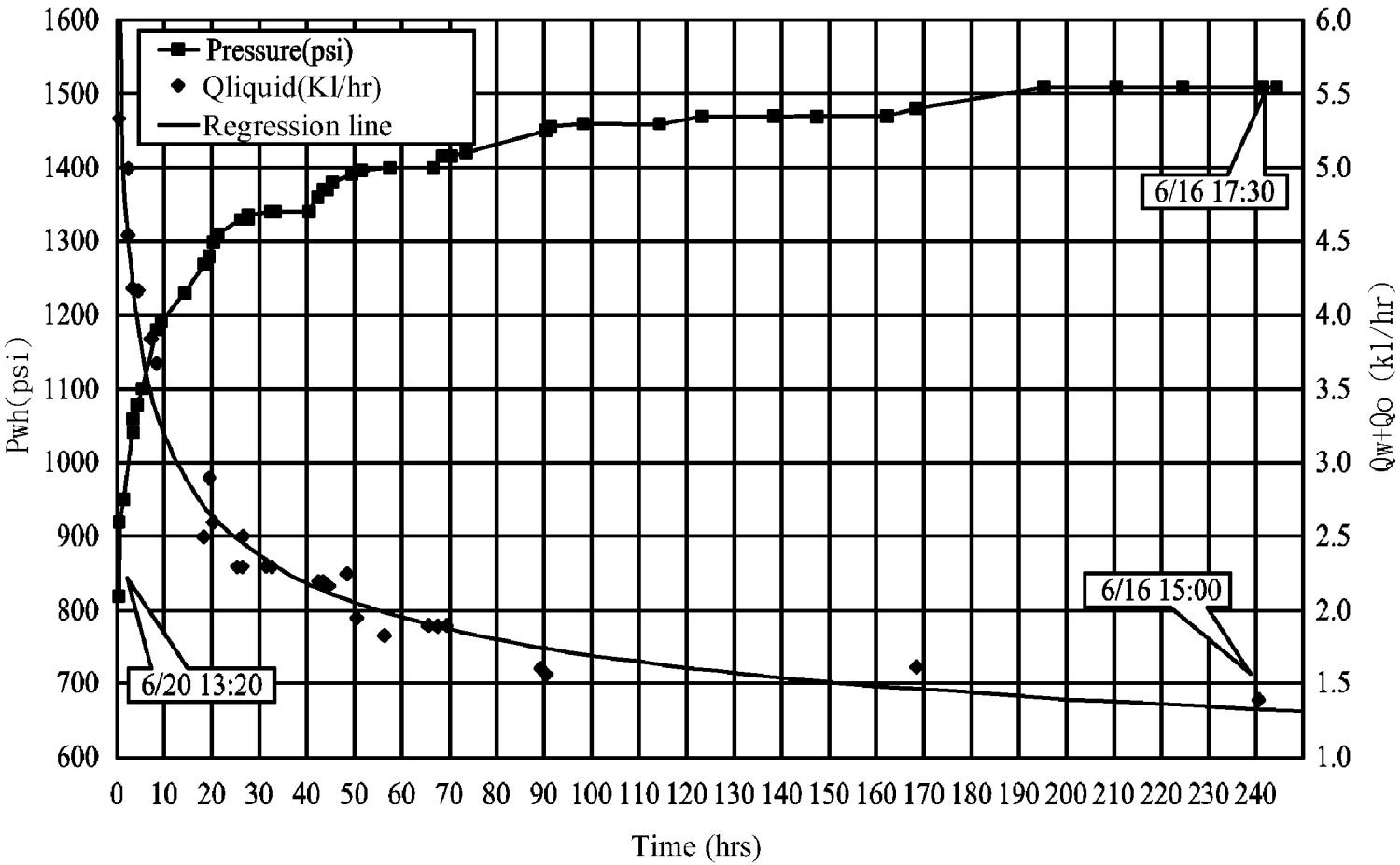
FIG. 11 is a graph showing changes in the wellhead flow pressure and the water volume in a second stage gas flow test conducted after the third time of cement dumping according to the method of the present invention.

In the second stage, a 32/64" choke is still used to open the well for production. The well is opened for 11 days. During this period, the well head flow pressure gradually rises from 820 psi to 1510 psi, and the volume of produced water gradually decreases to 1.40 KL/hour (containing condensed oil), as shown in FIG. 11.

Figure 12:
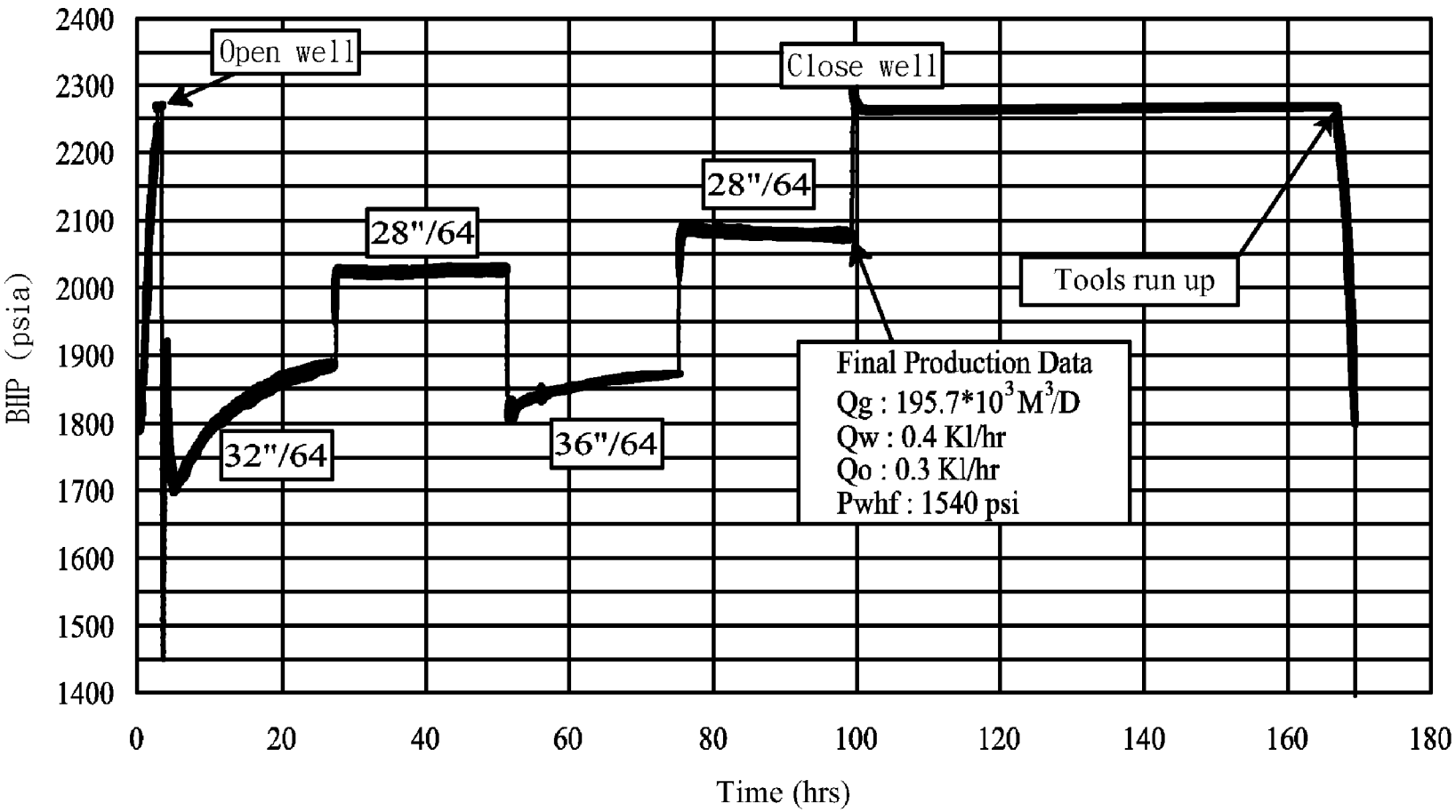
FIG. 12 is a graph showing changes in the bottom-hole flow pressure in a third stage flow test conducted after the third time of cement dumping according to the method of the present invention.
Figure 13:
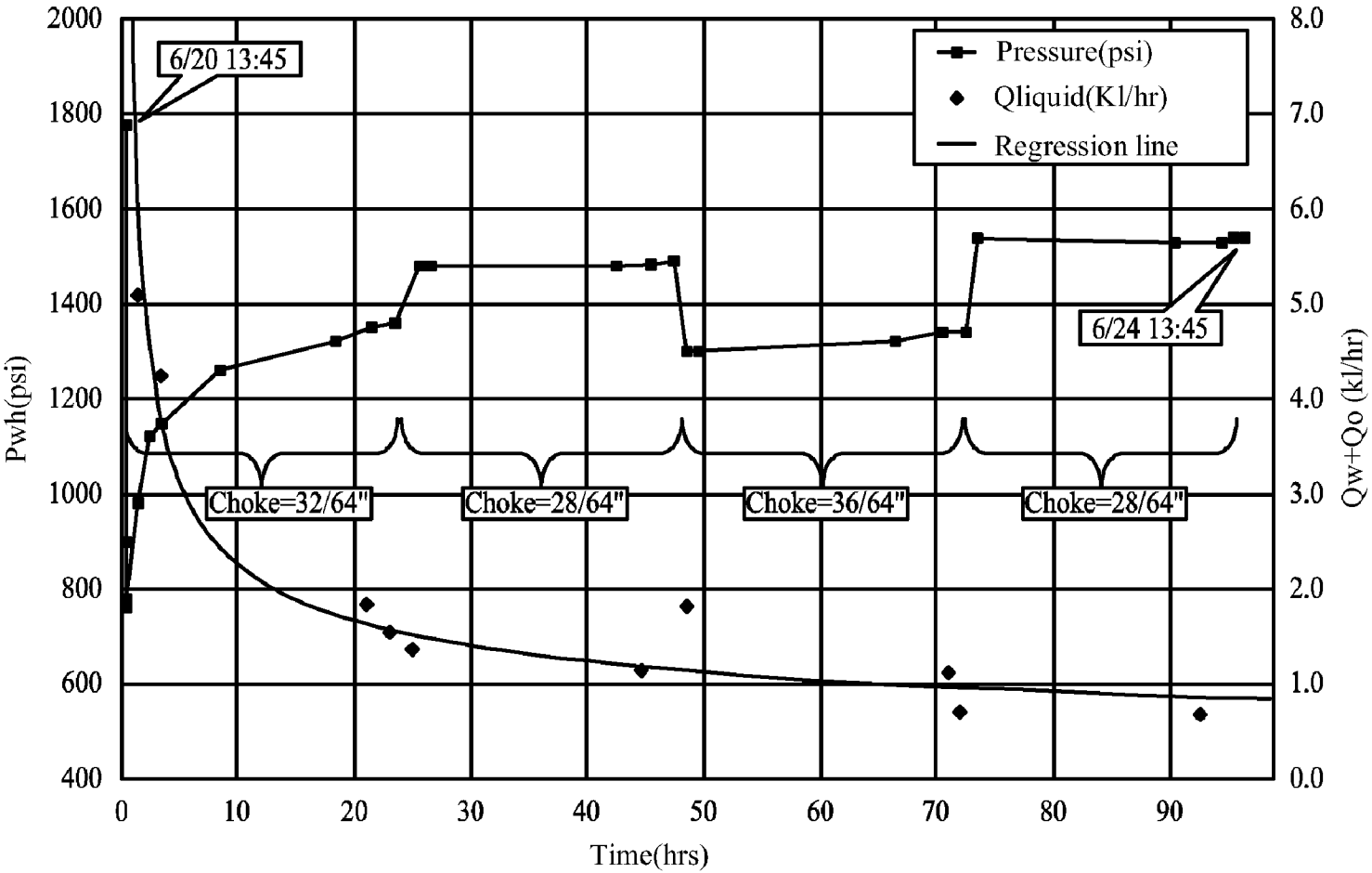
FIG. 13 is a graph showing changes in the bottom-hole flow pressure and the water volume in a third-phase flow test conducted after the third time of cement dumping according to the method of the present invention.

Please refer to FIGS. 12 and 13. In the third stage, the well is opened for 4 days. Before the well is closed, the gas production is about 200,000 cubic meters per day, and the produced water decreases to 0.3 KL/hour (excluding the condensed oil which is about 0.4 KL/hour; therefore, the total oil/produced water is 0.7 KL/hour) or 7.2 KL/day, which is lower than the measuring standard of 1 KL/104 cubic meters of natural gas normally adopted by the natural gas industry.

At the third time of cement dumping, the total time of gas injection before and after the cement dumping is 27 hours. The formation water nearby the well bore is outward pushed by the injected gas into the formation. When the well is reopened for production, the water saturation near the borehole in the initial stage is considerably low, and as a result, there is not produced water. However, after a continuous production, water tends to flow back toward the borehole, and the water head would reach the well bore. In the beginning, the produced water volume is somewhat high, but it gradually decreases as time goes. Data about the rising of the bottom-hole flow pressure at the final well closing stage is analyzed, and the results are shown in FIG. 12. As can be seen from FIG. 12, the effective permeability (Ke) in the formation decreases from the original 260 md to 190 md, and the skin factor near the well bore increases from the original 6 to 56.8. These data further prove the water saturation of the producing formation within the sweep range is still high. Particularly, since gas and water near the borehole radially concentrate toward the wellhead, the water saturation near the borehole is even higher. Therefore, it can be confirmed that the produced water comes from the water that is accumulated in the two upper sub-formations and flowed toward the borehole, instead of coming from the bottom water in the third sub-formation due to water coning.

In the overall working operations, the water blocking effect is also judged based on changes in the salinity and hardness of the produced water. For the target well, the water produced along with the natural gas comes from two sources, namely, formation water and condensed water. The formation water has a relatively high salinity, while the condensed water has a salinity usually as low as several tens to several hundreds ppm. Since the volume of condensed water is low, it is the high volume of formation that results in high salinity in the produced water.

Figure 14:
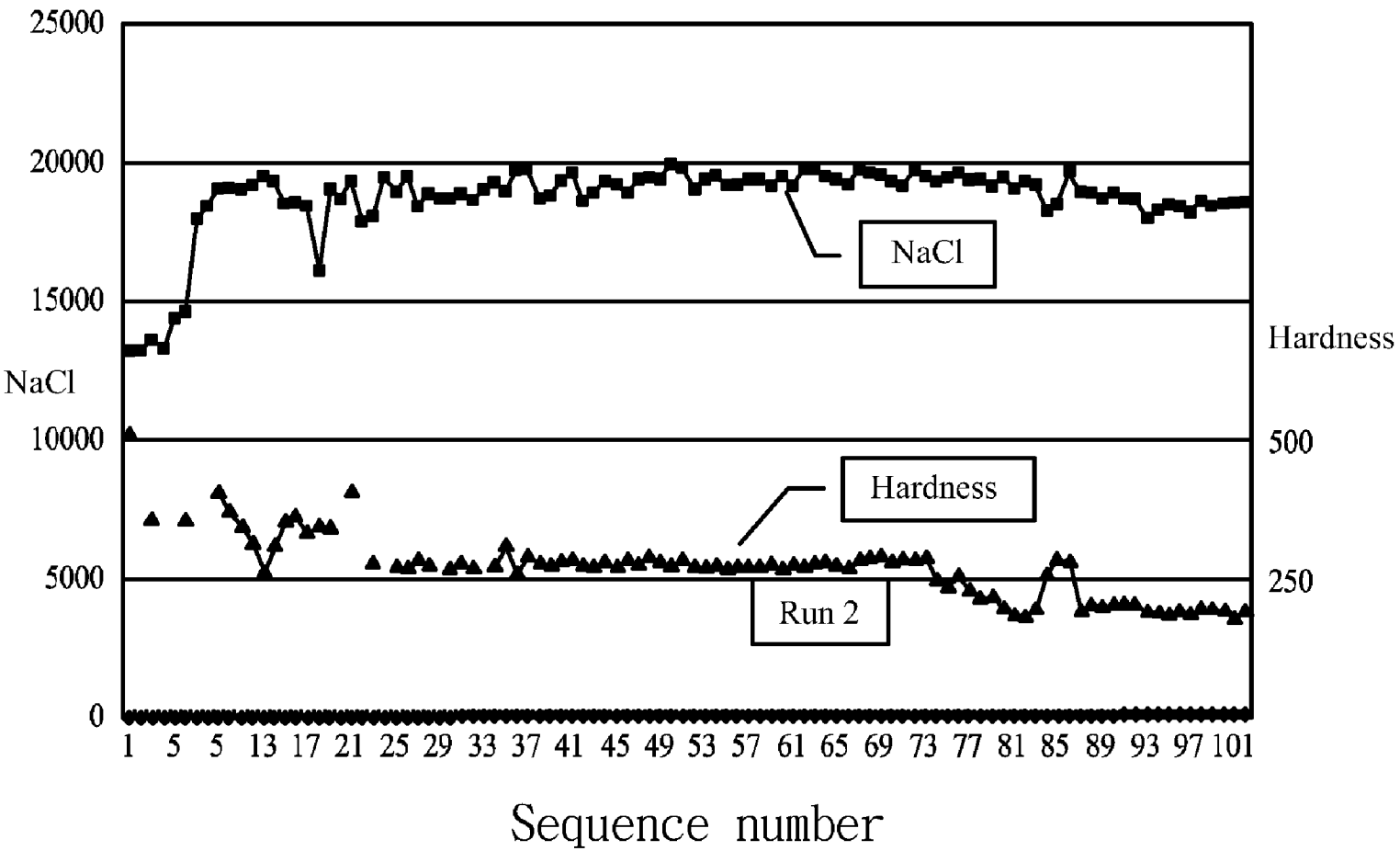
FIG. 14 is a graph showing the results from an analysis of formation water during the period within which the gravel packed production well produces gas flow.

Please refer to FIG. 14. Before the water blocking technique of the present invention is implemented in the target well, the salinity of the produced water is maintained in the range from about 19000 ppm to about 20000 ppm. After the first to the third water blocking operations by dumping cement under injection of pressurizing gas, the salinity of the produced water in the production well starts decreasing, which indicates that the volume of formation water flowed into the well has significantly reduced. In addition, according to a monitoring of the hardness of the produced water in the production well, the water hardness in the very beginning is relatively high but keeps unchanged later. After the second time of water blocking operation by dumping cement under injection of pressurizing gas, the water hardness is significantly reduced. It is guessed that, after the second cement dumping, the produced water does not come from the third sub-formation but from the two upper sub-formations and is produced along with the gas flow.

The effect of the present invention is also proven in the following manner. There are another two production wells A, B located near the target well that are spaced at 300 meters apart. For the time being, the bottom-hole radial pressure of the well A, the target well, and the well B are 2315 psia, 2320 psia, and 2400 psia, respectively. Wherein, the well A is a normal production well, and the well B is water-invaded and no longer produces gas. From past records about the production wells in gas field, a water-invaded well has a bottom-hole pressure always higher than that of a non-water-invaded well; therefore, it can be confirmed that the third sub-formation of the target well has already been successfully blocked, and the produced water of the target well is the formation water in the upper two sub-formation produced along with the gas flow.

From the above analyses, it is decided that the third sub-formation of the target well has been completely isolated from the two upper sub-formations by the cement milk, and the water coning disappears. The current produced water volume of 7.2 KL/day will gradually decrease with the continuous gas production in the future.

In the water blocking method of present invention, accumulated water 12 in the well is pushed back into the formation by injecting natural gas into the well, so that the accumulated water 12 is gone. Since there is no longer any accumulated water in the well, the cement milk dumped in the well using the dump bailer 40 would not mixed with water to affect its specific gravity and setting rate. Meanwhile, gas is injected into the well to push and press the cement milk into gaps between the gravel layer and the well wall, so that the cement milk has an increased flow speed to completely block the water-out zone in shutting the water off.

The water blocking method of the present invention provides high economic effect because it is able to effectively increase the probability of successful water blocking, so that gas well that stops production due to water invasion can restore production to save the costs for drilling a new well.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A method of blocking a water-out zone in a gas well by dumping a blocking fluid and injecting a pressurizing gas, comprising the following steps:

(a) continuously injecting the pressurizing gas into the gas well for a first predetermined time period, so that water accumulated in the gas well is pushed and pressed back into a formation surrounding the gas well to keep the gas well in a water-free state;

(b) loading the blocking fluid in a dump bailer, and lowering the loaded dump bailer to block a water-out zone in the gas well;

(c) pausing the gas injection or decreasing a pressure of the injected gas for a second predetermined period of time when the dump bailer has reached at the water-out zone, and keeping a wellhead shut-in pressure higher than a wellhead pressure before the gas injection;

(d) controlling the dump bailer to open a bottom opening thereof to release the loaded blocking fluid, so that the blocking fluid is accumulated in the water-out zone; and (e) resuming the gas injection and continuously increase the pressure of the injected gas until the blocking fluid is cured and hardened to form a reliable water blocked zone at the water-out zone.

2. The water blocking method as claimed in claim 1, wherein the blocking fluid is cement milk.

3. The water blocking method as claimed in claim 2, wherein the cement milk is so prepared that it has a plastic viscosity less than 22 cp.

4. The water blocking method as claimed in claim 2, wherein the blocking fluid is released from the dump bailer at a predetermined flow speed, and the dump bailer is slowly lifted by a predetermined distance while the blocking fluid is released.

5. The water blocking method as claimed in claim 1, wherein the blocking fluid is liquid resin.

6. The water blocking method as claimed in claim 1, wherein the pressurizing gas is natural gas.

7. The water blocking method as claimed in claim 1, wherein the dump bailer has a throttle unit mounted to a bottom end thereof for controlling the loaded blocking fluid to release from the dump bailer at a predetermined flow speed.

8. The water blocking method as claimed in claim 1, wherein the predetermined period of time for pausing the gas injection is from 10 to 30 minutes.

9. The water blocking method as claimed in claim 1, wherein, when the blocking fluid has completely released from the dump bailer, the gas injection is resumed and continues until the blocking fluid is fully cured and hardened.

* * * * *